US011751701B2

(12) United States Patent
Shaffer

(10) Patent No.: US 11,751,701 B2
(45) Date of Patent: Sep. 12, 2023

(54) MODULAR STACK DISPLAYS

(71) Applicant: WestRock Shared Services, LLC, Atlanta, GA (US)

(72) Inventor: Douglas E. Shaffer, Winston-Salem, NC (US)

(73) Assignee: WestRock Shared Services, LLC, Atlanta, GA (US)

( * ) Notice: Subject to any disclaimer, the term of this patent is extended or adjusted under 35 U.S.C. 154(b) by 0 days.

(21) Appl. No.: 17/237,109

(22) Filed: Apr. 22, 2021

(65) Prior Publication Data

US 2021/0330095 A1 Oct. 28, 2021

Related U.S. Application Data

(60) Provisional application No. 63/014,738, filed on Apr. 24, 2020.

(51) Int. Cl.

| | |
|---|---|
| ***A47F 5/11*** | (2006.01) |
| ***A47F 5/10*** | (2006.01) |
| ***A47B 55/06*** | (2006.01) |
| ***A47B 87/02*** | (2006.01) |
| ***A47B 47/06*** | (2006.01) |

(52) U.S. Cl.

CPC ..... *A47F 5/116* (2013.01); *A47B 47/06* (2013.01); *A47B 55/06* (2013.01); *A47B 87/0207* (2013.01); *A47F 5/108* (2013.01)

(58) Field of Classification Search

CPC .. A47F 5/116; A47F 5/108; A47F 5/11; A47F 5/112; A47F 5/114; A47F 5/10; A47B 43/02; A47B 47/06; A47B 55/06; A47B 47/0091; A47B 87/00; A47B 87/0207; A47B 87/0276; A47B 87/02; A47B 96/202; A47B 43/00; B65D 5/38; B65D 5/50; B65D 5/5028; B65D 25/10

USPC ..... 211/135, 72, 188, 192; 108/115; 312/258, 259; 206/736; 229/122, 913, 229/915

See application file for complete search history.

(56) References Cited

U.S. PATENT DOCUMENTS 1,670,498 A * 5/1928 Einson ..... B65D 5/4204 47/84
1,926,793 A * 9/1933 Richards ..... A47F 5/116 108/100
1,962,833 A * 6/1934 Nuckols ..... A47F 5/112 229/5.7
2,150,743 A * 3/1939 Mancuso ..... A47F 5/116 229/108.1
2,706,066 A * 4/1955 Wells ..... A47F 1/08 221/92
3,089,632 A * 5/1963 Bartolucci ..... B65D 5/4204 229/161
3,126,844 A * 3/1964 Burne et al. ..... A47F 5/116 108/179
3,372,813 A * 3/1968 Ishida ..... A47F 5/116 211/135

(Continued)

*Primary Examiner* — Jennifer E. Novosad
(74) *Attorney, Agent, or Firm* — Neil G. Cohen; Rohini K. Garg

(57) ABSTRACT

A display system comprises a sleeve with a plurality of apertures defined therethrough, and a plurality of support inserts arranged in a stack within the sleeve, wherein at least one of the support inserts is aligned with one or more of the apertures to provide a shelf accessible through the one or more of the apertures.

14 Claims, 9 Drawing Sheets

(56) References Cited

U.S. PATENT DOCUMENTS 3,834,324 A * 9/1974 Lang ..... A47B 87/0246 108/190
3,847,460 A * 11/1974 Weidt ..... A47B 47/04 312/265.2
3,860,305 A * 1/1975 Bergman ..... B65D 5/48046 312/114
3,862,689 A * 1/1975 Taub ..... B65D 5/001 211/126.2
3,863,575 A * 2/1975 Kuns ..... A47B 43/02 108/179
3,877,396 A * 4/1975 Patterson ..... A47B 47/06 108/183
4,182,244 A * 1/1980 Hutchins, Jr. ..... A47B 47/06 108/53.1
4,231,299 A * 11/1980 Gebhardt ..... A47F 5/116 108/190
4,506,790 A * 3/1985 Muscari ..... A47F 5/116 108/180
4,618,115 A * 10/1986 Belokin, Jr. ..... A47F 5/116 211/135
4,630,740 A * 12/1986 Belokin, Jr. ..... A47F 5/116 211/194
4,809,847 A * 3/1989 Schneider ..... B65D 5/16 206/45.28
4,854,246 A * 8/1989 Belokin ..... A47F 5/116 108/162
4,860,667 A * 8/1989 Cardenas ..... A47B 3/00 108/115
4,911,311 A * 3/1990 Nagai ..... A47F 5/116 211/11
4,942,830 A * 7/1990 Macaluso ..... A47B 43/02 108/162
5,000,376 A * 3/1991 Wojdyla ..... B65D 5/505 410/121
5,042,651 A * 8/1991 Davis ..... A47F 5/116 211/132.1
5,067,609 A * 11/1991 Stout ..... B65D 5/4804 206/216
5,141,105 A * 8/1992 Maye ..... A47F 1/08 211/135
5,183,166 A * 2/1993 Belokin, Jr. ..... A47F 5/116 211/130.1
5,193,466 A * 3/1993 Eder ..... A47F 5/116 108/166
5,315,936 A * 5/1994 Smith ..... A47F 5/116 108/165
5,322,172 A * 6/1994 Maglione ..... A47F 5/116 211/126.16
5,335,593 A * 8/1994 Stoddard ..... A47F 5/116 100/165
5,443,168 A * 8/1995 Dyment ..... A47F 5/116 211/149
5,564,578 A * 10/1996 Smith ..... A47F 5/04 211/133.1
5,566,961 A * 10/1996 Snell ..... A47B 31/00 220/4.31
5,632,390 A * 5/1997 Podergois ..... A47F 5/116 211/149
5,836,455 A * 11/1998 Connor ..... B65D 5/504 206/757
5,984,120 A * 11/1999 Johnske ..... A47F 5/114 211/126.16
6,068,140 A * 5/2000 Mangrum ..... A47F 5/116 108/107
6,105,796 A * 8/2000 Buchanan ..... A47F 9/04 186/59
6,113,203 A * 9/2000 Chen ..... A47B 43/00 312/258
6,915,907 B2 * 7/2005 Myers ..... B65D 5/4804 206/782
6,955,268 B2 * 10/2005 Waldron ..... A47F 7/145 211/194
7,066,342 B2 * 6/2006 Baechle ..... B65D 71/0096 206/600
7,089,872 B2 * 8/2006 Wintermute, II ..... A47F 5/116 108/165
7,111,735 B2 * 9/2006 Lowry ..... B65D 5/52 206/586
7,252,200 B1 * 8/2007 Hester ..... A47F 5/116 211/126.16
7,367,460 B2 * 5/2008 Hirsch ..... A47F 5/0025 211/11
7,584,854 B2 * 9/2009 Chandaria ..... B65D 5/5445 206/774
8,157,112 B2 * 4/2012 Bojie ..... A47F 5/11 211/135
8,627,585 B2 * 1/2014 Herman Baran ..... A47F 5/112 40/538
8,651,297 B2 * 2/2014 Beaty ..... A47F 5/116 211/135
8,789,704 B2 * 7/2014 Nowak ..... B65D 5/724 229/122
8,833,573 B2 * 9/2014 Tomaszewski ..... B65D 19/385 211/126.12
8,985,328 B2 * 3/2015 Slaats ..... B65D 19/04 206/386
9,198,508 B1 * 12/2015 Kufel ..... A47B 47/0075
9,701,441 B2 * 7/2017 Slaats ..... A47F 5/0018
9,844,281 B2 * 12/2017 Fernandez ..... A47F 5/116
9,918,569 B1 * 3/2018 Abel ..... A47B 43/02
10,448,757 B2 * 10/2019 Urban ..... B65D 5/0218
10,448,758 B1 * 10/2019 Abel ..... A47F 5/116
10,524,588 B2 * 1/2020 Pratsch ..... A47B 43/02
10,568,422 B2 * 2/2020 Gibbons, Jr. ..... A47B 43/02
10,750,866 B2 * 8/2020 Grupenhof ..... A47B 57/54
11,019,943 B2 * 6/2021 Burgert ..... A47F 5/116
2004/0016375 A1 * 1/2004 Grueneberg ..... A47B 43/02 108/115
2004/0148825 A1 * 8/2004 Myers ..... A47F 5/116 40/124
2004/0195195 A1 * 10/2004 Mason ..... A47F 5/0018 211/134
2005/0022703 A1 * 2/2005 Wintermute, II ..... A47B 43/02 108/165
2005/0067321 A1 * 3/2005 Pitts ..... A47F 5/116 206/736
2007/0193479 A1 * 8/2007 Slaats ..... B65D 19/42 108/53.1
2007/0272639 A1 * 11/2007 Alexander ..... A47F 5/116 211/186
2009/0272756 A1 * 11/2009 Hackney ..... A47F 1/08 221/282
2011/0049072 A1 * 3/2011 Dewhurst ..... A47F 5/116 211/135
2012/0305512 A1 * 12/2012 L'Hotel ..... A47F 5/116 211/198
2013/0319963 A1 * 12/2013 Coon ..... B65D 5/002 211/149
2014/0008316 A1 * 1/2014 Herman Baran ..... A47F 5/116 211/132.1
2014/0014606 A1 * 1/2014 Mestres Armengol ..... A47F 5/116 211/135
2015/0114920 A1 * 4/2015 Kula ..... A47B 96/027 211/135
2017/0238727 A1 * 8/2017 Ertl ..... G09F 15/0062
2018/0146803 A1 * 5/2018 Urban ..... B65D 5/0218
2018/0160825 A1 * 6/2018 Abel ..... B65D 5/5213
2018/0192774 A1 * 7/2018 Grupenhof ..... A47B 57/265
2018/0293919 A1 * 10/2018 Ertl ..... A47F 5/0025
2019/0008290 A1 * 1/2019 Ertl ..... A47F 5/116
2019/0014927 A1 * 1/2019 Nixon ..... A47B 47/06
2019/0316620 A1 * 10/2019 Kwo Tzuo ..... A47B 96/024
2020/0037787 A1 * 2/2020 Pratsch ..... G09F 15/0062
2020/0113355 A1 * 4/2020 Hara ..... A47F 5/114
2020/0375375 A1 * 12/2020 Robinson ..... A47F 5/114

(56) References Cited

U.S. PATENT DOCUMENTS

| | | | | |
|---|---|---|---|---|
| 2021/0330095 | A1* | 10/2021 | Shaffer | A47F 5/108 |
| 2021/0361084 | A1* | 11/2021 | Sharon | A47F 5/114 |

* cited by examiner

MODULAR STACK DISPLAYS

BACKGROUND

1. Field

The present disclosure relates to product displays, and more particularly to retail displays that can be used to display products in a retail setting.

2. Description of Related Art

Product displays for retail settings can be permanent or non-permanent. Both types can include print and graphics. Typical non-permanent displays are made of paper or similar disposable or recyclable materials. There is a need for non-permanent displays for retail use that have similar upscale appearance to permanent displays. There is a need for such non-permanent displays that are made of disposable or recyclable material and yet are easy to build in the retail or fulfillment settings, and that have the load bearing capacity to hold heavy weight items. This disclosure provides a solution for these needs.

SUMMARY

In accordance with at least one aspect of this disclosure, a display system comprises a sleeve with a plurality of apertures defined therethrough, and a plurality of support inserts arranged in a stack within the sleeve, wherein at least one of the support inserts is aligned with one or more of the apertures to provide a shelf accessible through the one or more of the apertures.

Each support insert can include a shelf section and two opposed leg sections depending from the shelf section. The shelf section of the at least one support insert can be aligned with the one or more apertures. Each support insert can also include a plurality of pre-glued fold-up members. The pre-glued fold-up members can include a respective structural beam in each of the shelf section and the two opposed leg sections. The pre-glued fold-up members can also include a respective spaced apart pair of structural beams in each of the shelf section and two opposed leg sections.

The sleeve can have a rectangular foot print area, and the stack of support inserts can have a rectangular foot print area that fits within the rectangular foot print area of the sleeve. The support inserts can be in contact with an interior surface of the sleeve. Each aperture of the sleeve can include a folded panel connected to an outer surface of the sleeve along a fold line, where the folded panel can be folded inward to engage a respective one of the support inserts.

Three shelves can be formed in the sleeve and stack of support inserts. Each shelf can include, a shelf surface of a respective one of the support inserts, a front aperture with a front folded panel folded in from a front panel of the sleeve, and a back aperture opposite the front aperture with a back folded panel folded in from a back surface of the sleeve. The front and back folded panels can each engage the respective one of the support inserts.

A fourth support insert can be stacked in the stack on top of three respective support inserts corresponding to the three shelves. The fourth support insert can provide a uniform appearance of inner lateral walls of a top one of the shelves with a middle one and a lower one of the shelves. The sleeve can have an open top and bottom, where the bottom can include a frame of inward folded tabs configured to support the stack of support inserts. The system can also comprise product for display loaded into the support inserts.

A kit comprises a sleeve blank, and a plurality of support insert blanks in a stack of support inserts arranged within the sleeve. At least one of the support inserts is aligned with one or more apertures in the sleeve to provide a shelf accessible through the one or more of the apertures.

Each support insert blank can include foldably connected panels configured for forming a shelf section and two opposed leg sections depending from the shelf section. Each support insert blank can include a plurality of pre-glued fold-up members. The pre-glued fold-up members can each include a respective structural beam in each of the shelf section and the two opposed leg sections. The pre-glued fold-up members can each include a respective spaced apart pair of structural beams in each of the shelf section and two opposed leg sections.

The sleeve blank can have a rectangular foot print area, and the support insert blanks can be configured to form a stack of support inserts that can have a rectangular foot print area that can fit within the rectangular foot print area of the sleeve. The support inserts can be in contact with an interior surface of the sleeve. Each aperture of the sleeve blank can include a folded panel connected to an outer surface of the sleeve along a fold line, and the folded panel can be folded inward to engage a respective one of the support inserts.

The kit can also include at least one support insert blank that can be configured to stack together to form three shelves in the sleeve and a stack of support inserts. Each shelf can include a shelf surface of a respective one of the support inserts, a front aperture with a front folded panel folded in from a front panel of the sleeve, and a back aperture opposite the front aperture with a back folded panel folded in from a back surface of the sleeve. The front and back folded panels can each engage the respective one of the support inserts.

The kit can include a fourth support insert blank configured to be stacked in the stack on top of three respective support inserts corresponding to the three shelves. The fourth support insert can provide a uniform appearance of inner lateral walls of a top one of the shelves with a middle one and a lower one of the shelves.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
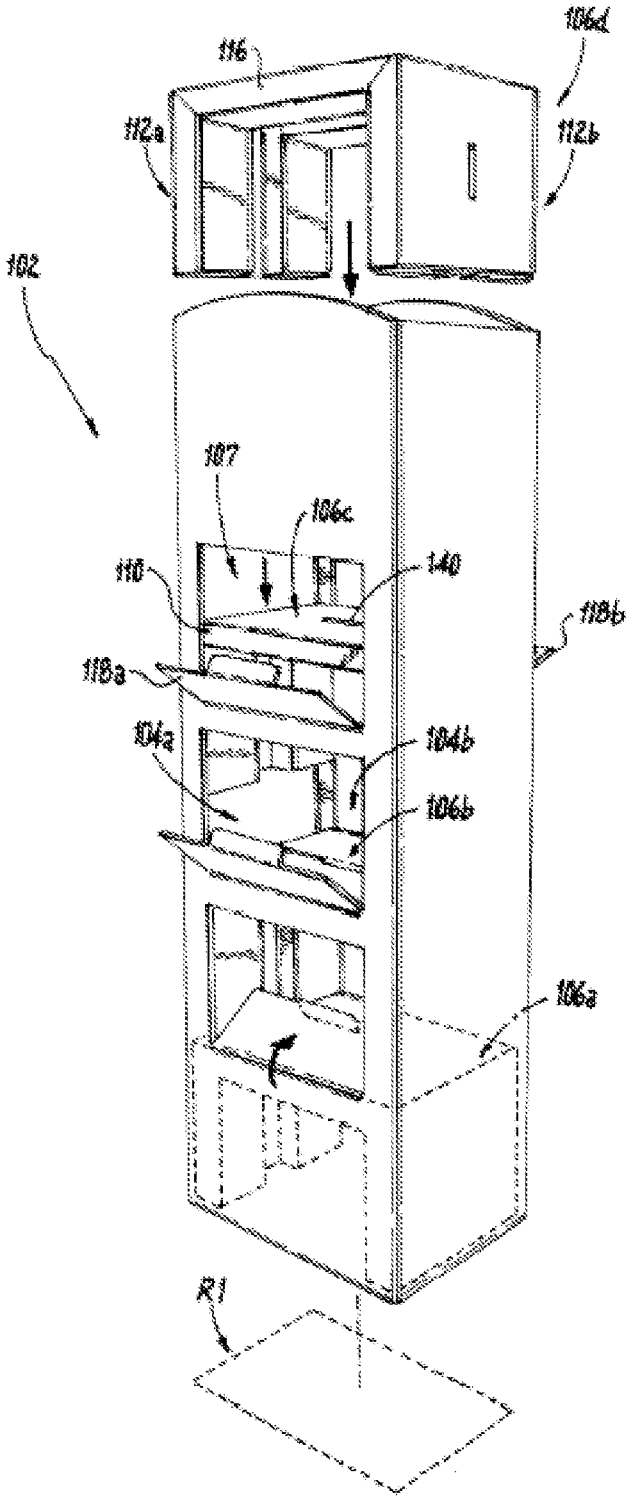
FIG. 1 is a schematic perspective view of an embodiment of a modular stack display constructed in accordance with the present disclosure, showing a sleeve having a plurality of support inserts therein.
Figure 2:
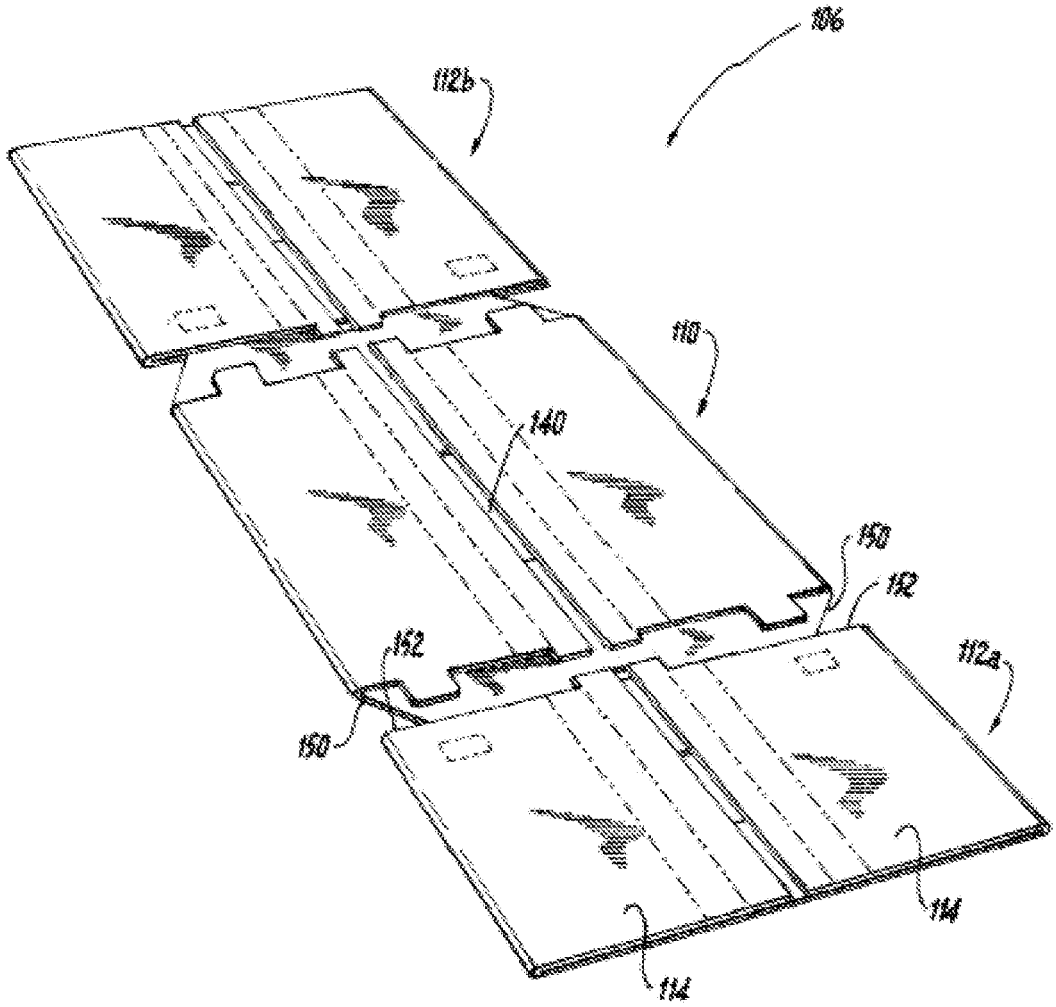
FIG. 2 is a schematic perspective view of a pre-glued, unfolded support insert.

Reference will now be made to the drawings wherein like reference numerals identify similar structural features or aspects of the subject disclosure. For purposes of explanation and illustration, and not limitation, a partial view of an embodiment of a modular stack display in accordance with the disclosure is shown in FIG. 1 and is designated generally by reference character 100. Other embodiments of systems in accordance with the disclosure, or aspects thereof, are provided in FIGS. 2-8, as will be described. The systems and methods described herein can be used to enhance product display, e.g. in a retail setting.

Figure 5:
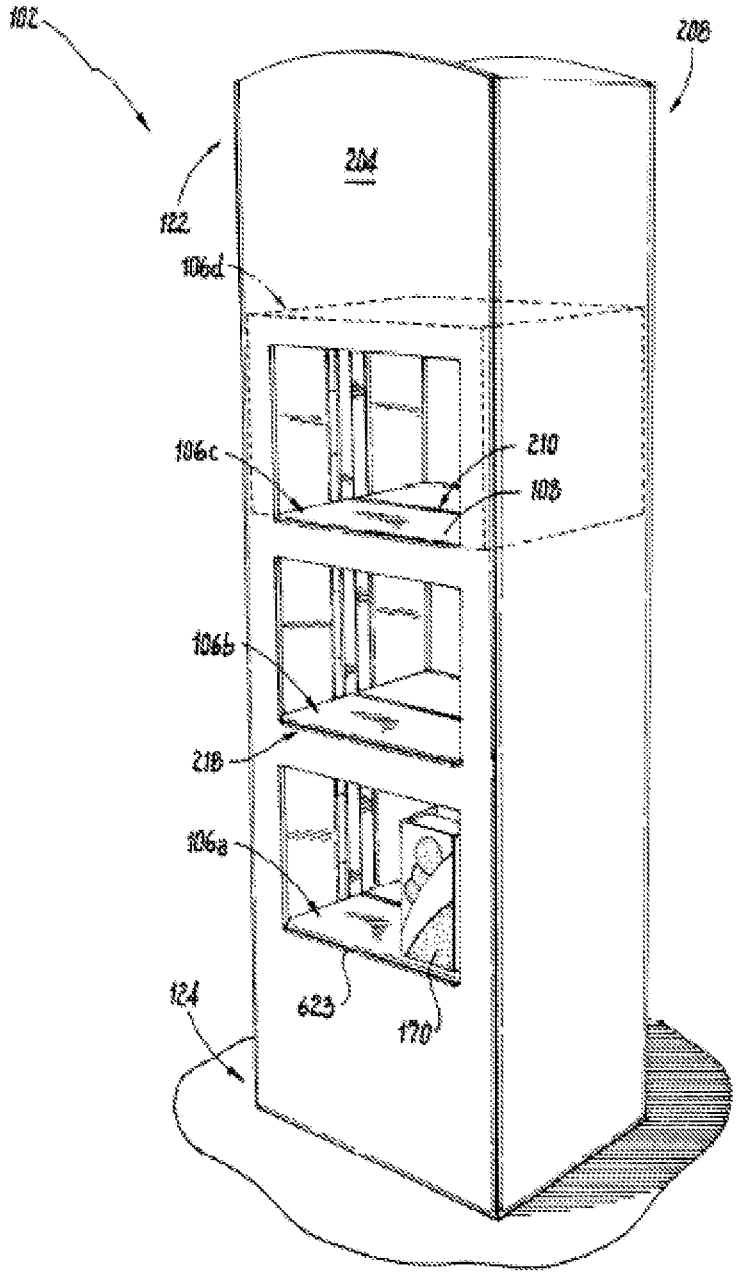
FIG. 5 is a schematic perspective view of a completed modular stack display.

A display system 100 comprises a sleeve 102. The sleeve can have a plurality of apertures 104 defined therethrough, and a plurality of support inserts 106 arranged in a stack 107 within the sleeve 102. When stacked in the sleeve 102, at least one of the support inserts 106 can be aligned with one or more of the apertures 104 to provide a shelf 108 that is accessible through the one or more of the apertures 104, as best seen in FIG. 5. In FIG. 1, apertures 104 are shown in on a front and back surface 204, 208 (for example front aperture 104*a*, and back aperture 104*b*), but apertures 104 on the back surface 204 can be omitted.

Figure 3:
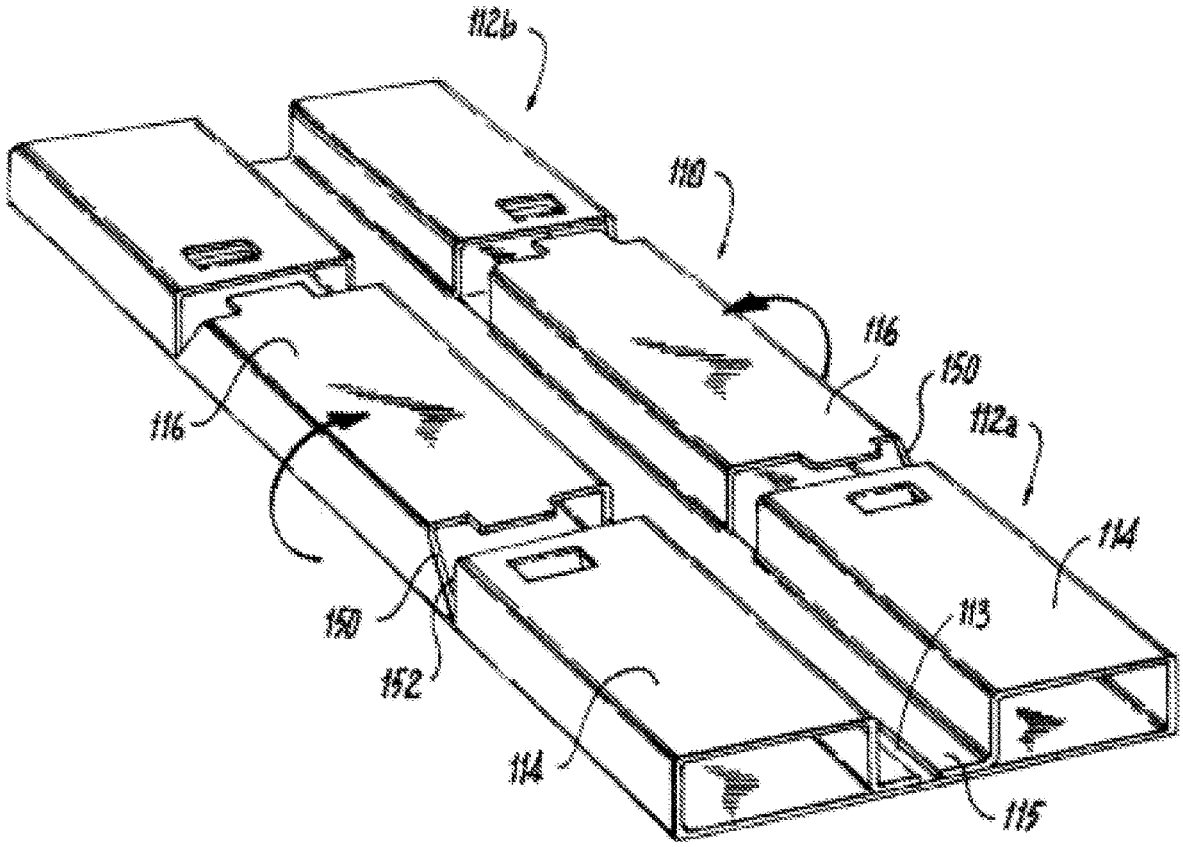
FIG. 3 is a schematic perspective view of a pre-glued, partially erected support insert.
Figure 4:
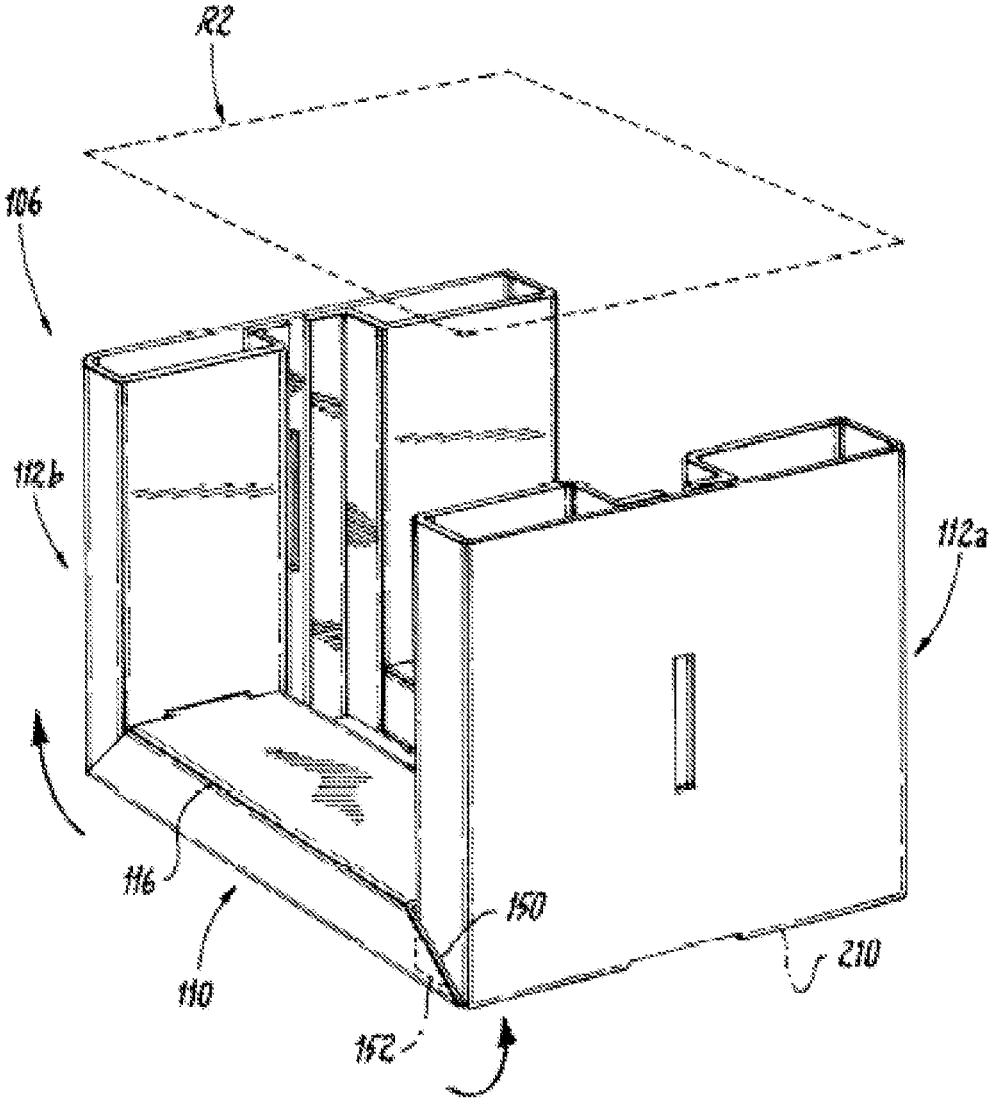
FIG. 4 is a schematic perspective view of an erected support insert.

Each support insert 106 can include a shelf section 110 and two opposed leg sections 112*a*, 112*b* that depend from the shelf section 110. Each support insert 106 can also include a plurality of pre-glued fold-up members 114 (for example shown flattened in FIG. 2). The pre-glued fold-up members 114 can include at least one respective structural beam 116 (as indicated by the curved arrows in FIG. 3) in each of the shelf section 110 and the two opposed leg sections 112*a*,112*b* (for example, structural beams 116 are shown erected in FIG. 3). Glue flap 115 (corresponding to attachment panel 730 in FIG. 7) is provided for optionally pre-gluing the pre-glued fold up members to a central panel 113 (corresponding to central panel 706 in FIG. 7). Fold up members 114 can also be erected and locked together without gluing, to form structural beams 116. The respective structural beams 116 can have at least one 45 degree miter 150 configured to allow joining flush a respective edge 152 of a respective opposed leg section 112*a*, 112*b* (e.g. as shown in FIG. 3).

The sleeve 102 can have a rectangular foot print area R1, and the stack of support inserts 107 can have a rectangular foot print area R2 (e.g. as shown by the dotted lines in FIG. 4) that fits within the rectangular foot print area of the sleeve R1. When inserted into the sleeve 102, the support inserts 106 can be in contact with an interior surface 202 of the sleeve 102. Each aperture 104 of the sleeve can include a folded panel 118 connected to an outer surface 204 of the sleeve 102 along a fold line 623, where the folded panel 118 can be folded inward to engage a respective one of the support inserts 106, forming a single smooth contiguous surface (e.g. as shown in FIG. 5). Folded panels 118 can also be configured to be removed from the sleeve. The stack of inserts 107 can include at least two support inserts 106, and can also include a fourth support insert 106*d* provide a uniform appearance of inner lateral walls 120 of a top one 106*c* of the shelves with a middle one 106*b* and a lower one 106*a* of the shelves 108, as shown in FIG. 1. FIG. 1 shows three shelves 108 formed from three support inserts 106, however any suitable number of support inserts 106 can be used to form any suitable number of shelves 108 within the sleeve 102.

Figure 6:
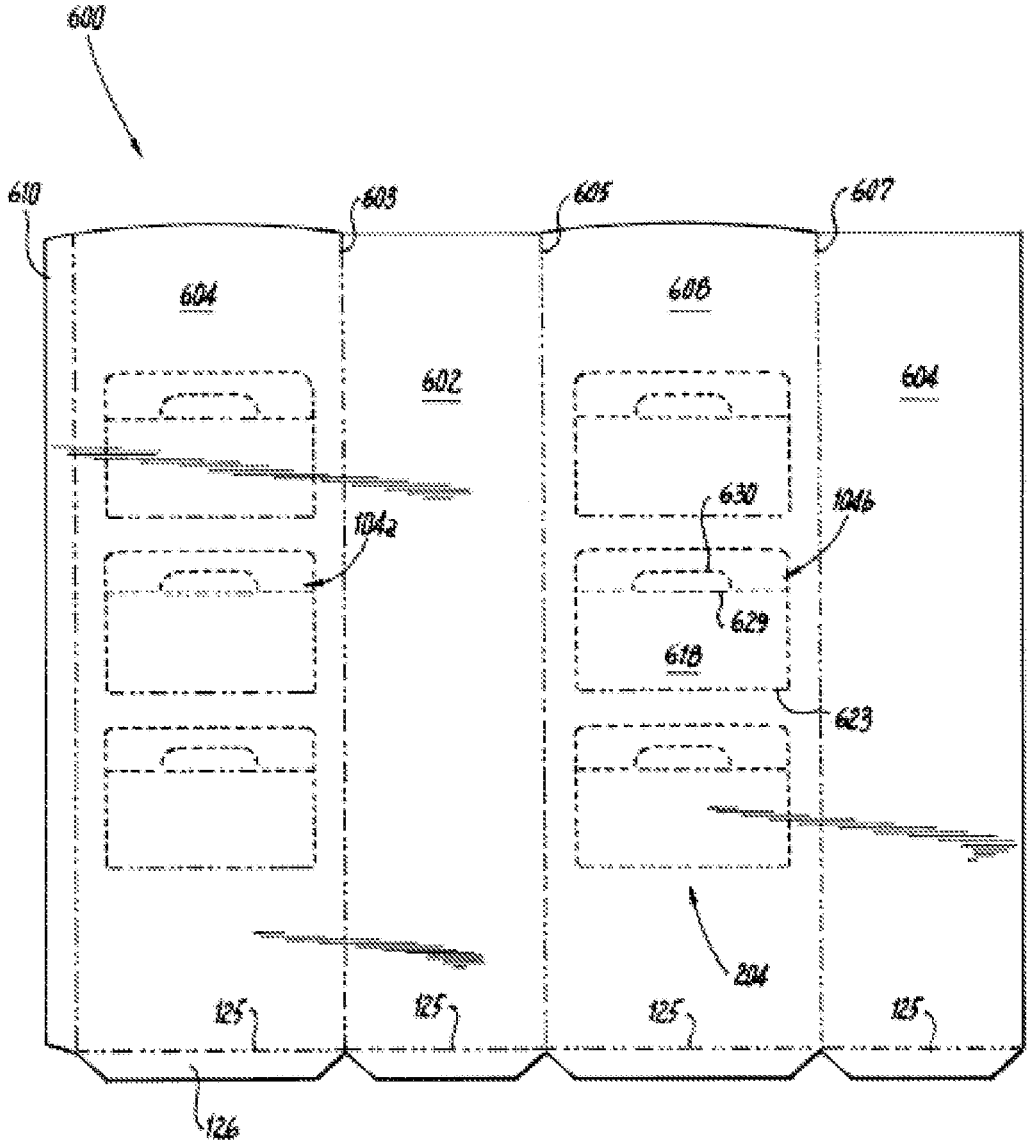
FIG. 6 is a plan view of a sleeve blank configured to form the sleeve of FIG. 1.

The sleeve 102 can have an open top 122 and bottom 124. The bottom of the sleeve 124 can include a frame of inward folded tabs 126 folded along fold lines 125 configured to support the stack 107 of support inserts 106 (e.g. as shown in FIG. 6). The system 100 can also comprise product for display 170 (e.g. as shown in FIG. 5) that can be loaded into the support inserts 106, for display on one of the shelves 108.

Each shelf 108 can include, a shelf surface 210 of a respective one of the support inserts 106 (as shown in FIG. 5), a front aperture 104 with a front folded panel 118*a* folded in from a front surface 204 of the sleeve 102 (corresponding to panel 604 in FIG. 6) as indicated by the curved arrow, and a back aperture 104*b* opposite the front aperture 104*a* with a back folded panel 118*b* folded in from a back surface 208 (corresponding to panel 608 in FIG. 6) of the sleeve 102. The front and back folded panels 118*a*, 118*b* can each engage the respective one of the support inserts 106, for example in slot 140.

The sleeve 102 can have an open top 122 and bottom 124 (e.g. as shown in FIG. 5). The bottom of the sleeve 124 can include a frame of inward folded tabs 126 configured to support the stack 107 of support inserts 106.

Figure 7:
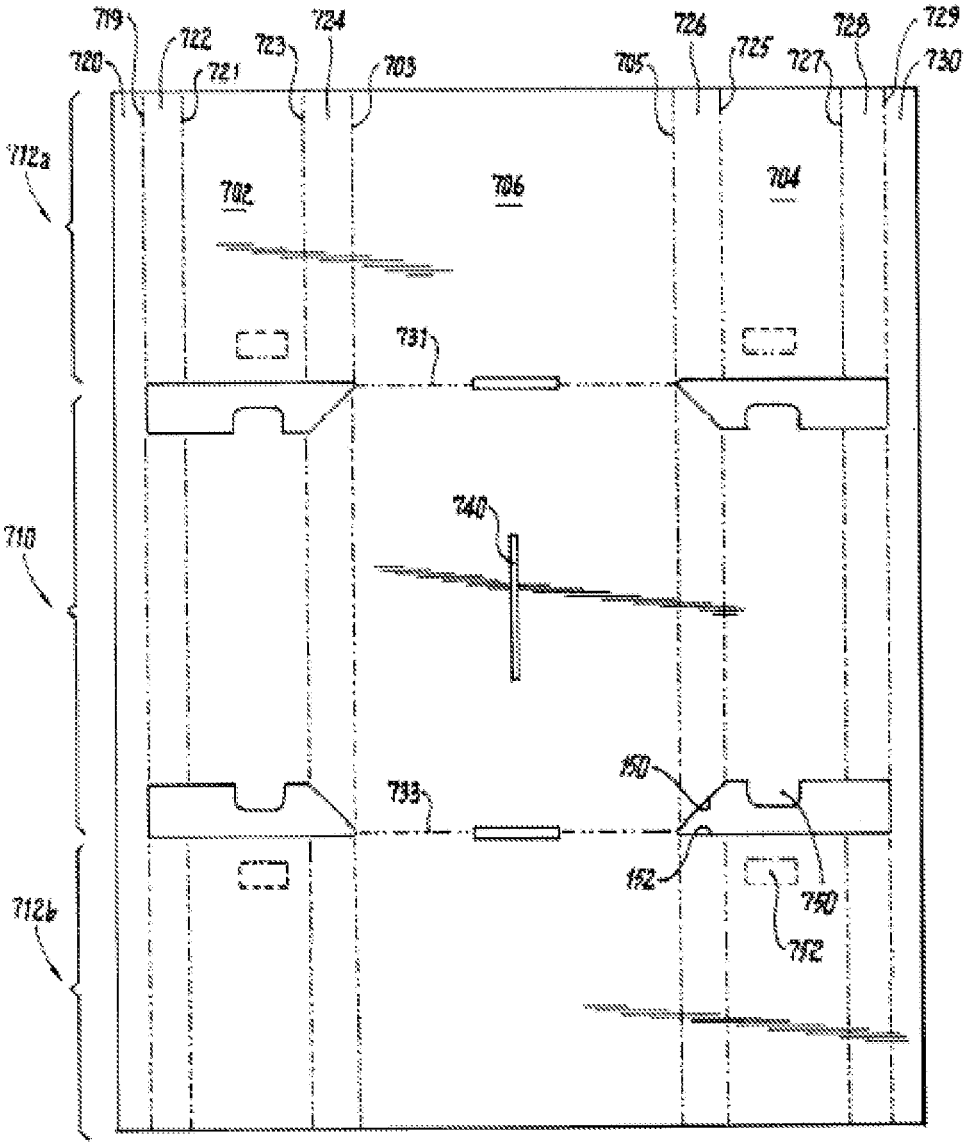
FIG. 7 is a plan view of a support insert blank configured to form the support insert of FIG. 4.
Figure 8:
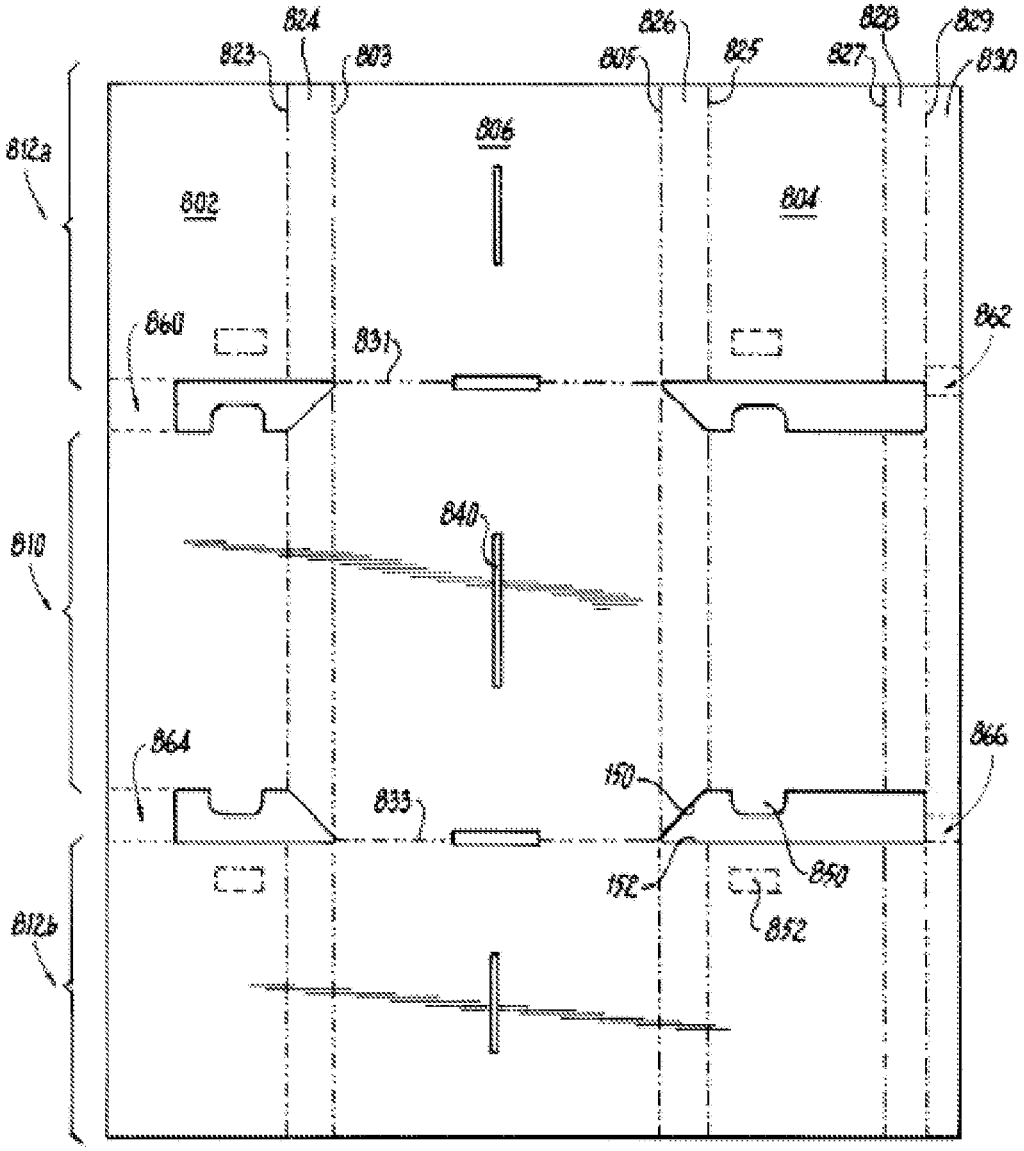
FIG. 8 is a plan view of another support insert blank configured to form a support insert with a single beam.

Referring to FIG. 6, a kit 200 comprises a sleeve blank 600 configured to form a sleeve 102, and a plurality of support insert blanks 700, 800 (e.g. as shown in FIGS. 7-8) each configured to form a support insert 106 in a stack of support inserts 107 that is arranged within the sleeve 102 (e.g. as shown in FIG. 1). The sleeve blank 600 comprises a first and second side panels 602, 604, front and back panels 606, 608, and attachment panel 610. First side panel 602 is connected to the front panel 604 over fold line 603, and is connected to the back panel 608 over fold line 605. The second side panel 604 is connected to the back side panel 608 over fold line 607 and is joined to the front panel 604 via attachment panel 610. The second side panel 604 can be joined to the front side panel by any suitable adhesive. The blank 600 can have at least one aperture 104 defined in front and back panels 606, 608, however the apertures in back panel 608 can be omitted. Each aperture 104 of the blank 600, can include a folded panel 618 connected to an outer surface 218 of the sleeve 102 along a fold line 623. The folded panel 618 can include a tab 630, and the folded panel 618 be folded inward along fold line 629 so that the tab 630 can engage a respective one of the slots 140 of a support insert 106. Panels 618 can also be configured to be removed from the sleeve blank. The features as described above have been shown in FIG. 6 with respect to the back panel 608, but should be understood to apply equally to the front panel 604.

As shown in FIG. 7, support insert blank 700 can include a first side panel 702 and second side panel 704, connected to a central panel 706 across fold lines 703 and 705 respectively. The first side panel 702 comprises attachment panel 720, panel 722, and panel 724. The attachment panel 720 is connected to panel 722 over fold line 719, panel 722 is connected to the first side panel 702 along fold line 721, panel 724 is connected to first side panel 702 along fold line 723. The second side panel 704 comprises attachment panel 730, panel 726, and panel 728. The attachment panel 730 is connected to panel 728 over fold line 729, panel 728 is connected to the second side panel 704 along fold line 727, panel 726 is connected to second side panel 704 along fold line 725. Support insert blank 700 can include slot 740 for engaging tab 630 of a folded panel 618 of the sleeve 102.

Each support insert blank 700 can be configured to form a support insert 106 by folding first and second side panels 702, 704 along fold lines 703 and 705, and adhering attachment panels 720 and 730 to a portion of central panel 706 forming respective structural beams 116 (e.g. as shown in FIG. 3). Folding side panels 704 and 706 in this manner forms the structure of the support insert 106 shown in FIG. 3. The support insert 106 further comprises a folded shelf section 710 and two opposed leg sections 712*a*, 712*b*, connected to and depending from the shelf section 710 at fold lines 731 and 733. The opposed leg sections 712*a*, 712*b* can be folded along fold lines 731 and 733 to join the shelf section 710 at miter 150 and edge 152. Shelf section 710 can comprise tabs 750 configured to engage respective slots 752 in respective opposed leg sections 712*a*, 712*b*. Attachment panels 720 and 730 may or may not be pre-glued to central panel 706. If attachment panels 720 and 730 are not pre-glued, forming the support insert 106 may require folding as described above. If the attachment panels 720 and 730 are pre-glued to central panel 706, as shown in FIG. 3, forming the support insert may only require erecting, and folding the opposed leg sections 712*a*, 712*b* along fold lines 731 and 733.

Figure 9:
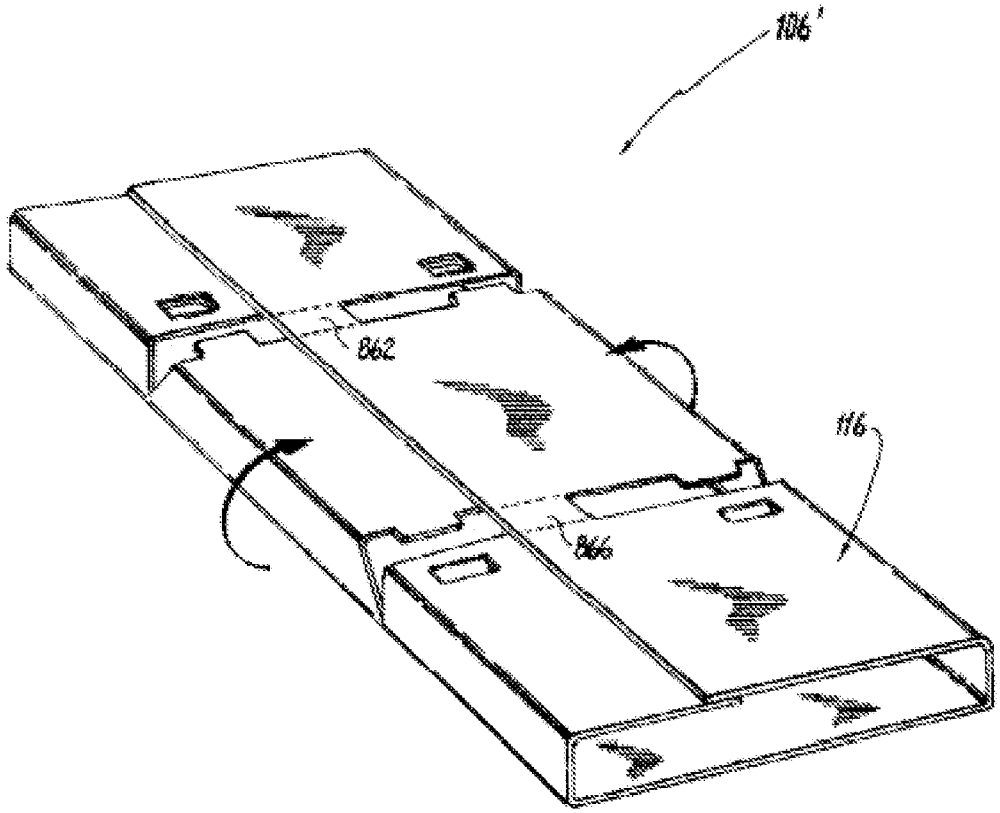
FIG. 9 is a schematic perspective view of another erected support insert.

The kit 200 can also include at two three blanks 700, or any other suitable number of blanks, and the kit 200 can optionally include the blanks pre-glued as described above. Shown in FIG. 8, the kit 200 can include another support insert blank 800 for forming that can be used with sleeve 102, referred to as support insert 106'. Support insert blank 800 is largely similar to support insert blank 700, but alternative blank 800 forms a support insert 106' that comprises only a single structural beam 116. First side panel 802 folds along fold line 803 to a point over central panel 806, and second side panel 804 folds along fold line 805 to a point over central panel 806, where attachment panel 830 adheres directly to a portion of first side panel 802 forming the single structural beam 116 (e.g. as shown in FIG. 9).

The alternative support insert 106' further comprises a folded shelf section 810 and two opposed leg sections 812*a*, 812*b*, connected to and depending from the shelf section 810 at fold lines 831 and 833. The opposed leg sections 812*a*, 812*b* can be folded along fold lines 831 and 833 to join the shelf section 810 at miter 150 and a respective edge 152. Shelf section 810 can comprise tabs 850 configured to engage respective slots 852 in respective opposed leg sections 812*a,b*. Attachment panel 830 may or may not be pre-glued to the first side panel 802. If attachment panels 830 is not pre-glued, forming the support insert 106' may require folding as described above. If the attachment panel 830 is pre-glued to first side panel 802, similar to that shown in FIG. 3, forming the support insert may only require erecting and folding the opposed leg sections 812*a*, 812*b* along fold lines 831 and 833. Support insert blank 800 can include perforated punch-outs 860, 862, 864, and 866, configured to be removed when support insert blank 800 is folded into support insert 106'.

These and other features of the systems and methods of the subject disclosure will become more readily apparent to those skilled in the art from the following detailed description of the preferred embodiments taken in conjunction with the drawings.

The methods and systems of the present disclosure, as described above and shown in the drawings, provide for enhanced product display. The modular stacking display allows for a temporary display unit having added strength and a large printable surface area. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A display system comprising:

a sleeve with a plurality of apertures defined therethrough wherein the sleeve includes four side; and a plurality of support inserts arranged in a stack within the sleeve, wherein at least one of the support inserts is aligned with one or more of the plurality of apertures such that at least one of the support inserts is co-planar to the one or more of the plurality of apertures in the sleeve to provide a shelf accessible through the one or more of the apertures, wherein each support insert includes a shelf section and two opposed leg sections depending from the shelf section, wherein the shelf section of the at least one support insert is aligned with the one or more apertures, wherein each support insert includes a plurality of pre-glued fold-up members, wherein the pre-glued fold-up members include a respective structural beam in each of the shelf section and the two opposed leg sections.

2. The system as recited in claim 1, wherein the pre-glued fold-up members include a respective spaced apart pair of structural beams in each of the shelf section and two opposed leg sections.

3. The system as recited in claim 1, wherein the sleeve has a rectangular foot print area, and wherein the stack of support inserts has a rectangular foot print area that fits within the rectangular foot print area of the sleeve wherein the support inserts are in contact with an interior surface of the sleeve.

4. The system as recited in claim 1, wherein each aperture of the sleeve includes a folded panel connected to an outer surface of the sleeve along a fold line, wherein the folded panel is folded inward to engage a respective one of the support inserts.

5. The system as recited in claim 4, wherein there are three shelves formed in the sleeve and stack of support inserts, wherein each shelf includes:

a shelf surface of a respective one of the support inserts;

a front aperture with a front folded panel folded in from a front panel of the sleeve; and a back aperture opposite the front aperture with a back folded panel folded in from a back surface of the sleeve, wherein the front and back folded panels each engage the respective one of the support inserts.

6. The system as recited in claim 5, wherein a fourth support insert is stacked in the stack on top of three respective support inserts corresponding to the three shelves, wherein the fourth support insert provides a uniform appearance of inner lateral walls of a top one of the shelves with a middle one and a lower one of the shelves.

7. The system as recited in claim 1, wherein the sleeve has an open top and bottom, wherein the bottom includes a frame of inward folded tabs configured to support the stack of support inserts.

8. The system as recited in claim 1, further comprising product for display loaded into the support inserts.

9. A kit comprising:

a sleeve blank having four sides configured to form a sleeve; and a plurality of support insert blanks each configured to form a support insert in a stack of support inserts arranged within the sleeve, wherein at least one of the support inserts is aligned with one or more apertures in the sleeve such that at least one of the support inserts is co-planar to the one or more of the plurality of apertures in the sleeve to provide a shelf accessible through the one or more of the apertures, wherein each support insert blank includes foldably connected panels configured for forming a shelf section and two opposed leg sections depending from the shelf section, wherein each support insert blank includes a plurality of pre-glued fold-up members and wherein the pre-glued fold-up members include a respective structural beam in each of the shelf section and the two opposed leg sections.

10. The kit as recited in claim 9, wherein the pre-glued fold-up members include a respective spaced apart pair of structural beams in each of the shelf section and two opposed leg sections.

11. The kit as recited in claim 9, wherein the sleeve blank has a rectangular foot print area, and wherein the support insert blanks are configured to form a stack of support inserts that has a rectangular foot print area that fits within the rectangular foot print area of the sleeve, wherein the support inserts are in contact with an interior surface of the sleeve.

12. The kit as recited in claim 9, wherein each aperture of the sleeve blank includes a folded panel connected to an outer surface of the sleeve along a fold line, wherein the folded panel is folded inward to engage a respective one of the support inserts.

13. The kit as recited in claim 12, wherein the kit includes at least one support insert blank that is configured to stack together to form three shelves in the sleeve and a stack of support inserts, wherein each shelf includes:

a shelf surface of a respective one of the support inserts;

a front aperture with a front folded panel folded in from a front panel of the sleeve; and a back aperture opposite the front aperture with a back folded panel folded in from a back surface of the sleeve, wherein the front and back folded panels each engage the respective one of the support inserts.

14. The kit as recited in claim 13, wherein a fourth support insert blank is included to be stacked in the stack on top of three respective support inserts corresponding to the three shelves, wherein the fourth support insert provides a uniform appearance of inner lateral walls of a top one of the shelves with a middle one and a lower one of the shelves.

* * * * *